US005450775A

United States Patent [19]

Kozak

[11] Patent Number: 5,450,775

[45] Date of Patent: Sep. 19, 1995

[54] MULTI-FUNCTION DRIVING TOOL

[76] Inventor: Burton Kozak, 1300 N. Lake Shore Dr., #28C, Chicago, Ill. 60610

[21] Appl. No.: 376,041

[22] Filed: Jan. 20, 1995

Related U.S. Application Data

[63] Continuation of Ser. No. 179,483, Jan. 7, 1994, abandoned.

[51] Int. Cl.[6] ..... B25B 23/00

[52] U.S. Cl. ..... 81/440; 81/450; 81/490; 81/177.4

[58] Field of Search ..... 81/437–440, 81/450, 490, 177.2, 177.4–177.6, 177.8, 125, 124.5, 124.1, 125.1

[56] References Cited

U.S. PATENT DOCUMENTS

| | | | |
|---|---|---|---|
| 2,629,415 | 2/1953 | Baker | 81/450 X |
| 4,448,097 | 5/1984 | Rocca | 81/439 X |
| 4,676,703 | 6/1987 | Swanson | 81/440 X |
| 4,848,197 | 7/1989 | Kikel | 81/440 |

*Primary Examiner*—D. S. Meislin

*Attorney, Agent, or Firm*—Marshall, O'Toole, Gerstein, Murray & Borun

[57] ABSTRACT

In order to enhance the availability of tools, a multi-function tool includes a handle having first and second ends with the first end having an opening for receiving a screwdriver tip, and the second end having an opening for receiving a tube which is releaseably retained in relation to the handle by a collet. The handle has opposed side openings extending from the second end to a point near the collet. The tube is mounted for limited axial sliding movement relative to the handle from a position where one of its ends is retained by the collet to a position where it is no longer retained by the collet to position the tube in alignment with the side openings in the handle. The tube is also mounted for pivoting movement when it is in alignment with the side openings to a generally transversely extending position. The tube cooperates with the handle in the generally transversely extending position to define a T-shaped handled for applying increased torque to the first handle end. With this construction, a screwdriver tip is also operatively associated with each of the ends of the tube to project outwardly of the second end of the handle when the other of the ends of the tube is retained by the collet.

15 Claims, 2 Drawing Sheets

MULTI-FUNCTION DRIVING TOOL

This is a Rule 62 file wrapper continuation of U.S. application Ser. No. 08/179,483, filed Jan. 7, 1994, now abandoned.

FIELD OF THE INVENTION

The present invention is generally related to tools and, more particularly, a multi-function driving tool that can be carried in a shirt pocket.

BACKGROUND OF THE INVENTION

From the earliest times in recorded history, there have been continuing efforts to develop the tools that could ease the burdens of mankind. Initially, such tools were very primitive, but, in recent years, both manual and powered tools have become more sophisticated and specialized to address the widely varying needs that are faced in modern life. However, while such tools have been highly beneficial, there have remained a number of vexing problems of rather significant proportions.

As a matter of fact, the very development of such specialized tools has, ironically, turned out to be nothing more than a mixed benefit. On the one hand, it has facilitated the ability to complete a wide range of different tasks, but, on the other hand, the sheer number of tools which is required today is oftentimes staggering and expensive. On the down side, even if one has all of the tools that are required to complete a given task, there can be practical problems in their use.

More specifically, it is sometimes difficult to find a needed tool due to the sheer number of tools that must be owned. There is also another problem in that switching from one tool to another can be time consuming and frustrating, particularly if the worker is in a position of limited access where it is impossible to maintain in close proximity all of the tools that may be needed to perform a particular task. In fact, this can in some instances actually pose not only an unwanted hindrance to completing a task but also a safety hazard.

In line with the present invention, it is very well known that there exists a wide variety of fasteners and sizes of fasteners that are available for a multitude of different purposes. It is oftentimes the case that a worker will need to be installing and/or removing fasteners of different types and sizes in rapid succession, and this also frequently occurs in many instances at a time when a worker is not at or near a supply of tools, such as a tool box or the like. For this purpose, it would be highly desirable to have a multi-function driving tool that could be carried in a shirt pocket to successfully accomplish this objective in a highly effective manner.

The present invention is directed to overcoming one or more of the foregoing problems and achieving one or more of the resulting objects.

SUMMARY OF THE INVENTION

It is therefore a principal object of the present invention to enhance the general availability of tools to thereby successfully achieve a far greater degree of worker efficiency. It is a further object of the present invention to provide a unique multi-function driving tool that can be utilized for a variety of different fastener installing and removing applications and the like. It is an additional object of the present invention to provide a unique driver for screws and/or nuts and/or bolts that is specifically adapted to be carried in a shirt pocket.

Accordingly, the present invention is directed to a multi-function tool comprising an elongated handle having an axis with first and second ends disposed in axially spaced relation. The first end of the handle has an opening for axially receiving a screwdriver tip therein, and the second end of the handle has an opening for receiving an elongated tube which is releaseably retained in generally axially aligned relation to the handle by a collet. With these features of construction, the handle has opposed side openings extending axially from the second end to a point near the collet for a purpose that will be clear below.

More specifically, the multi-function tool includes means for pivoting the elongated tube relative to the elongated handle from a position in generally axially aligned relation to the handle to a position extending generally transversely thereof. The pivoting means accommodates limited axial sliding movement of the tube relative to the handle from a position where one of the ends of the tube is axially retained by the collet to a position where the one of the ends of the tube is no longer axially retained by the collet to thereby position the tube so as to be generally in axial alignment with the side openings in the handle. As a result, the pivoting means can then accommodate pivoting movement of the tube about an axis generally transverse to the axis of the handle through either of the side openings to the generally transversely extending position.

In this manner, the elongated tube is adapted to cooperate with the elongated handle in the generally transversely extending position to define a generally T-shaped handle. This makes it possible to apply increased torque to the screwdriver tip in the first handle end or, alternatively, to the first handle end itself when that end of the handle is used for the purpose of driving a nut or bolt head. Also, a screwdriver tip is associated with each of the ends of the tube to project axially outwardly of the second end of the handle when the other of the ends of the tube is axially retained by the collet.

In the exemplary embodiment, the opening in the first end of the elongated handle is preferably formed so as to be generally hexagonal and of a preselected size in cross section. The screwdriver tip in the opening in the first end of the handle then advantageously has an elongated shank of the same size and also hexagonal in cross section and further has a driving tip on each of opposite ends of the shank. Further, the multi-function tool preferably includes means for releaseably retaining the screwdriver tip in the opening in the first end of the handle with one of the driving tips projecting therefrom.

In like manner, the elongated tube preferably has an opening formed so as to be generally hexagonal and of a preselected size in cross section in each of the ends thereof. The screwdriver tips operatively associated with the tube each then also advantageously has an elongated shank which is of a preselected size and hexagonal in cross section and further has a driving tip on each of the opposite ends of the shank. Further, the multi-function tool preferably includes means for releaseably retaining the screwdriver tips in the openings in the ends of the tube with one of the driving tips projecting therefrom.

In a highly preferred embodiment, the pivoting means includes a pair of axially extending slots in the handle near the second end thereof. The axially extending slots are advantageously formed in the handle to lie in a plane extending generally transversely of a plane in which the tube undergoes pivoting movement relative to the handle. Further, the pivoting means preferably includes pin means associated with the tube and projecting into the slots to accomplish relative sliding and pivoting movement.

Still additionally, the elongated shanks are preferably formed so as to be of a length which is sufficient for at least a portion of each of the shanks to extend from each of the openings in the ends of the elongated tube. The collet is then advantageously formed so as to be generally hexagonal in cross section in order to receive the portion of the shank extending from the opening in either one of the ends of the elongated tube to thereby serve as the means by which the ends of the tube are axially retained by the collet. Further, the multi-function tool preferably includes means associated with the collet such as magnetic attraction for the extending shank portion in either end for releaseably retaining the tube in generally axially aligned relation to the handle.

In a most highly preferred embodiment, the handle is defined by four sides so as to be generally square in cross section. The tube is advantageously generally circular in cross section and of a diameter less than the spacing between inner surfaces of opposing sides of the handle to accommodate pivoting movement of the tube relative to the handle. Preferably, the opposed side openings in the handle are sufficiently wide to accommodate pivoting movement of the tube relative to the handle.

In addition, the elongated tube is advantageously formed to be of a length which is greater than the distance between the collet and the second end of the elongated handle. And the pivoting means preferably includes a pin extending transversely of the axis of the tube and disposed in the pair of axially extending slots in the handle. Advantageously, the slots are positioned and of a length to permit either end of the tube including the screwdriver tip contained therein to be pivoted freely through either of the side openings in the handle.

As for other details, the hexagonal opening in the first end of the handle is of a size to receive a standard hexagonal nut or bolt head therein, and the hexagonal openings in each of the ends of the tube are also of a size to receive a standard hexagonal nut or bolt head therein. The handle, tube and screwdriver tips are all formed of metal which preferably has been magnetized either permanently or by strategic placement of a magnet or magnets therewithin. Furthermore, the handle preferably has a pocket clip integrally associated with one of the sides of the handle adjacent the first end thereof, and the magnetized metal comprises the means for releaseably retaining the screwdriver tips in the openings as well as in the collet.

Other objects, advantages and features of the present invention will become apparent from a consideration of the following specification taken in conjunction with the accompanying drawings.

DETAILED DESCRIPTION OF THE PREFERRED EMBODIMENT

Figure 2:
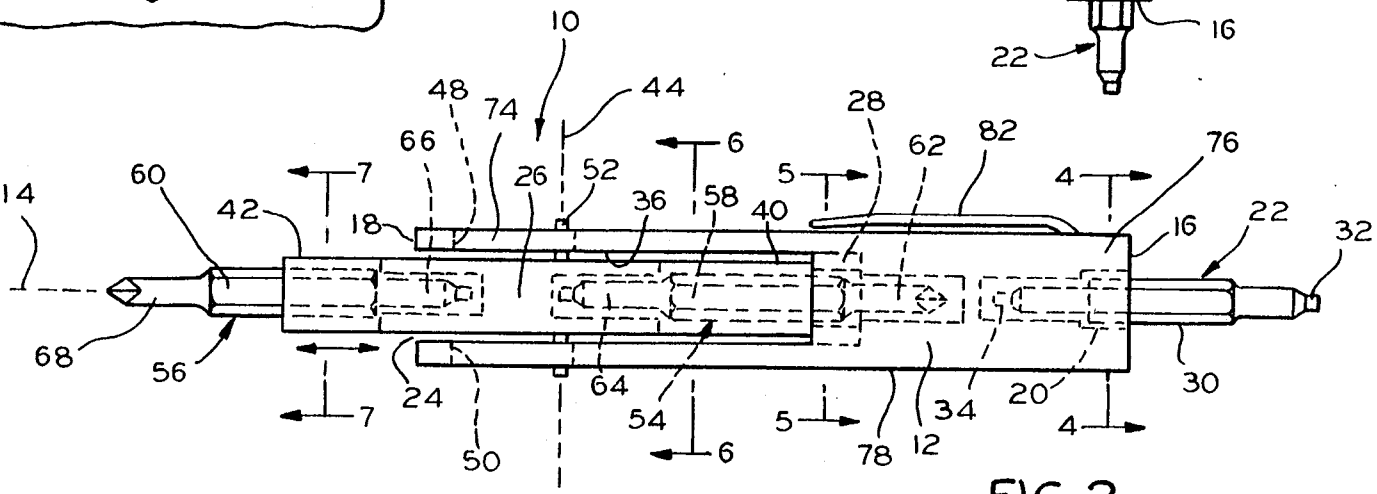
FIG. 2 is a side elevational view of the multi-function tool of FIG. 1 with the tube in a first position relative to the handle.
Figure 1:
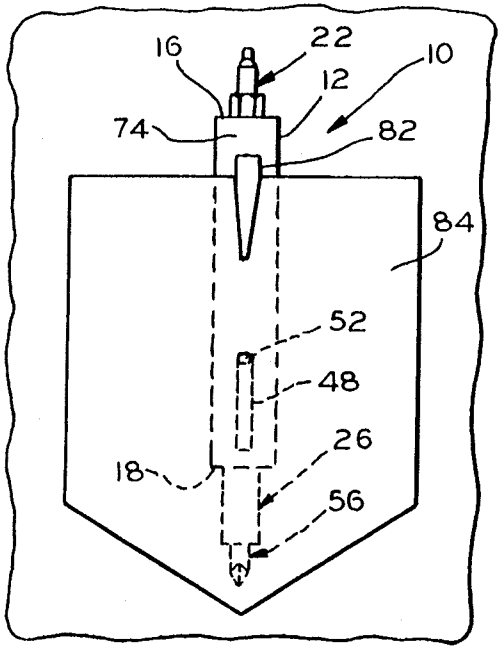
FIG. 1 is a perspective view of a multi-function tool carried in a shirt pocket in accordance with the present invention.

In the illustrations given, and with reference first to FIGS. 1 and 2, the reference numeral 10 designates generally a multi-function driving tool in accordance with the present invention comprising an elongated handle 12 having an axis 14 with first and second ends 16 and 18 in axially spaced relation. The first end 16 of the handle 12 has an opening 20 (see FIG. 4) for axially receiving a screwdriver tip 22 therein, and the second end 18 of the handle 12 has an opening 24 for receiving an elongated tube 26. As will be appreciated by referring in particular to FIG. 2 and as will be described in greater detail hereinafter, the elongated tube 26 is releaseably retained in generally axially aligned relation to the handle 12 by means of a collet 28 (see, also, FIG. 5).

Figures 4, 5, 6, 7:
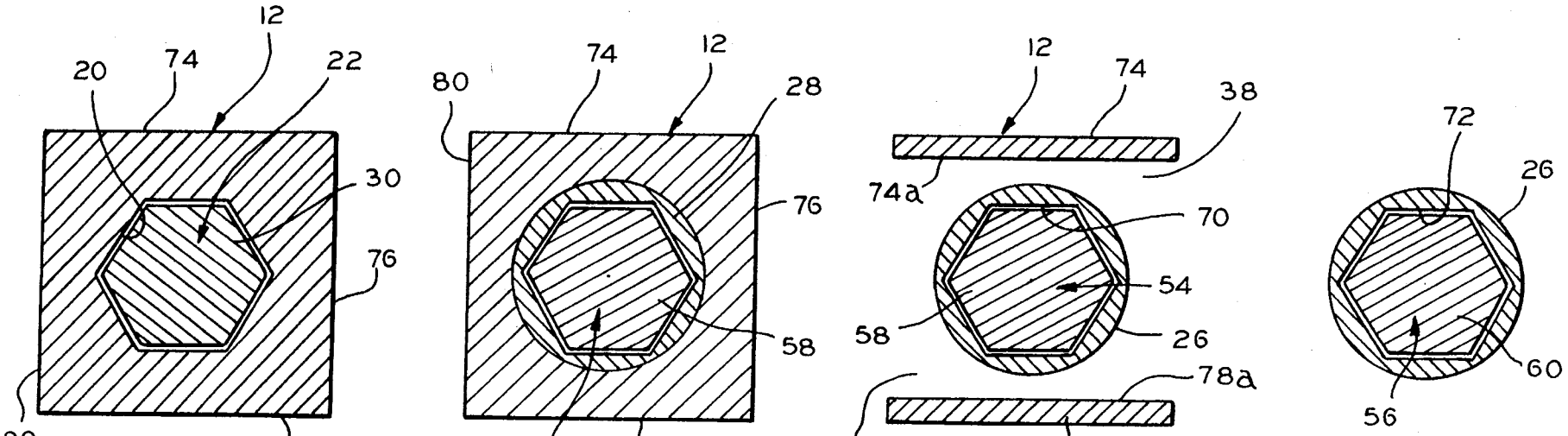
FIG. 4 is a cross-sectional view taken on the line 4—4 of FIG. 2.
FIG. 5 is a cross-sectional view taken on the line 5—5 of FIG. 2.
FIG. 6 is a cross-sectional view taken on the line 6—6 of FIG. 2.
FIG. 7 is a cross-sectional view taken on the line 7—7 of FIG. 2.

Referring to FIG. 2, the screwdriver tip 22 in the first end 16 of the elongated handle 12 has an elongated shank 30 which is hexagonal in cross section and has a driving tip 32 and 34 on each of the opposite ends of the shank 30. The opening 20 in the first end 16 of the handle 12 also is generally hexagonal in cross section as best shown in FIG. 4 and the opening 20 and shank 30 are of very approximately the same preselected size. Further, the multi-function tool 10 will be understood to include means for releaseably retaining the screwdriver tip 22 in the opening 20 in the first end 16 of the handle 12 such that one of the driving tips 32 or 34 is projecting therefrom.

As best shown in FIGS. 2 and 6, the handle 12 has opposed side openings 36 and 38 which are formed so as to extend axially from the second end 18 to a point which is axially near the collet 28. It will also be appreciated by comparing FIGS. 2 and 3 that the multi-function tool 10 includes means for pivoting the elongated tube 26 relative to the elongated handle 12 from a position where it is in generally axially aligned relation to the handle 12 to a position where it extends generally transversely thereof. In this connection, the pivoting means accommodates limiting axial sliding movement of the tube 26 relative to the handle 12 in a unique manner that will be understood to derive from the features of the invention.

More specifically, the pivoting means accommodates limited axial sliding movement of the tube 26 relative to the handle 12 from a position where one of the ends 40 or 42 is axially retained by the collet 28 to a position where that end is no longer axially retained by the collet 28. This positions the tube so that the one of the ends 40 or 42 which had formerly been axially retained by the collet 28 is generally in alignment with the side openings 36 and 38 in the handle 12, i.e., there will be clearance for pivoting not only the tube 26 but also the screwdriver tip carried by the corresponding on of the ends 40 or 42. When in this position, the pivoting means then accommodates pivoting movement of the tube 26 about an axis 44 extending generally transverse to the axis 14 of the handle 12 through either of the side openings 36 and 38 to the generally transversely extending position which is illustrated in FIG. 3.

Preferably, the pivoting means includes a pair of axially extending slots 48 and 50 formed in the handle 12 near the second end 18 to lie in a plane extending generally transversely of a plane in which the tube 26 undergoes pivoting movement. Advantageously, the pivoting means also includes a pin 52 integral with the tube 26 and extending transversely of the axis 14 of the handle 12 to project into the slots 48 and 50 to permit sliding and pivoting movement of the tube 26 relative to the handle 12.

Figure 3:
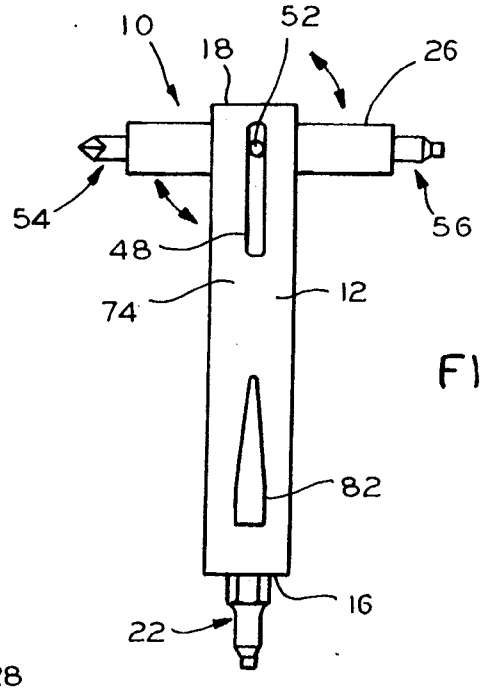
FIG. 3 is a side elevational view of the multi-function tool of FIG. 1 with the tube in a second position relative to the handle.

As best shown in FIG. 3, the elongated tube 26 cooperates with the elongated handle 12 in the generally transversely extending position to define a generally T-shaped handle for applying increased torque to the first end 16 of the handle 12. Thus, with the elongated tube 26 in the position shown in FIG. 3, increased torque can either be applied to the screwdriver tip 22 for tightening or loosening a screw or other fastener or, if the screwdriver tip 22 is removed, the increased torque can be applied to the first end 16 of the handle 12 for tightening or loosening a nut or bolt head. In other respects, the multi-function tool 10 also includes a screwdriver tip 54 and 56 operatively associated with each of the ends 40 and 42 of the tube 26 to project axially outwardly of the second end 18 of the elongated handle 12 when the other of the ends of the tube is axially retained by the collet 28.

As best shown in FIG. 2, the screwdriver tips 54 and 56 associated with the tube 26 each has an elongated shank 58 and 60, respectively, which is hexagonal in cross section and a driving tip 62, 64 and 66, 68, respectively, on each of the opposite ends of the shanks 58 and 60. The elongated tube 26 has an opening 70 and 72, respectively, which is also generally hexagonal in cross section in each of the ends 40 and 42 thereof, and the openings 70 and 72 will be appreciated as being appropriately sized relative to the corresponding hexagonal shanks 58 and 60 of the screwdriver tips 54 and 56 so as to slidably receive them. Still additionally, the multi-function tool 10 includes means for releaseably retaining the screwdriver tips 54 and 56 in the openings 70 and 72 in the ends 40 and 42 of the tube 26 with one of the driving tips 62, 64 and 66, 68 projecting therefrom substantially as shown in FIG. 2.

Referring to FIGS. 2 and 5, the collet 28 is also formed to be generally hexagonal in cross section to receive at least a portion of the shank 58 or 60 extending from the opening 70 or 72 in either one of the ends 40 and 42 of the elongated tube 26 when it is in generally axially aligned in relation to the handle 12. Also, the multi-function tool 10 preferably includes means associated with the collet 28 such as magnetic attraction caused by permanent magnetization or the placement of magnets therewithin. In this manner, the collet 28 cooperates with the portion of the shank 58 or 60 extending from the opening 70 or 72 in either one of the ends 40 or 42 for releaseably retaining the tube 26 in generally axially aligned relation to the handle 12 at any point in time.

By referring to FIGS. 4–7, it will be appreciated that the handle 12 is preferably defined by four sides 74, 76, 78 and 80 so as to be generally square in cross section. The elongated tube 26 will also be appreciated as being generally circular in cross section and of a diameter less than the spacing between inner surfaces **74*a* and 78*a* of opposing sides 74 and 78 of the handle 12 to accommodate pivoting movement of the tube 26 relative to the handle 12. Referring to FIG. 2, it will be appreciated that the tube 26 is of a length sufficient to always project outwardly of the handle 12 when the tube is generally in axially aligned relation to the handle 12**.

As will also be appreciated, the slots 48 and 50 are axially positioned and of a length to permit either end 40 or 42 of the tube 26 including the corresponding screwdriver tip 54 or 56 therein to be pivoted freely through either of the side openings 36 and 38 when the pin 52 is in the slots 48 and 50 at a point nearest the second end 18 of the handle 12.

With the present invention, the hexagonal opening 20 in the fist end 16 of the handle 12 is of a size to receive a standard hexagonal nut or bolt head therein, and the hexagonal openings 70 and 72 in each of the ends 40 and 42 of the tube 26 are also of a size to receive a standard hexagonal nut or bolt head therein. By way of example only, the openings 70 and 72 may advantageously comprise ¼" hex openings, i.e., ¼" female hex collets, for receiving ¼" hex double-ended screwdriver tips or, alternatively, ¼" hex nuts or bolt heads therein, with the collet depth being approximately ¾" on each end thereof, and the opening 20 in the first end 16 of the handle 12 can be in the form of a 5/16" hex female collet, again of approximately ¾" depth, to receive a 5/6" hex double-ended screwdriver tip or a 5/16" hex nut or bolt head. Still additionally, the handle, tube and screwdriver tips are all formed of metal which has been permanently magnetized or has magnets in close proximity such that the magnetized metal comprises the means for releaseably retaining the screwdriver tips in the openings in the first end 16 of the handle 12 and the ends 40 and 42 of the tube 26.

As shown in FIGS. 1–3, the multi-function driving tool. 10 also preferably includes a pocket clip 82 integrally associated with one of the sides 78 thereof whereby the tool 10 can be carried in a shirt pocket 84 substantially as shown.

As will further be appreciated, the tube 26 may cooperate with the collet 28 either indirectly through the hex shanks 58 and 60 on the screwdriver tips 54 and 56, respectively, or directly by forming the collet 28 to actually receive the ends 40 and 42 of the tube 26. The tube 26 can be moved axially to withdraw the exposed portion of the hex shanks 58 and 60 to the fullest extent with the pin 52 in engagement with the end of the slots 48 and 50 nearest the second end 18 of the handle 12, and then the tube 26 can be rotated by 90° to form a T-handle or by 180° to change to use of the other of the two screwdriver tips 54 and 56. When the tube 26 is again fully axially inserted into the handle 12 such that, e.g., the exposed portion of the hexagonal shank 58 or 60 is disposed in the collet 28, the multi-function tool 10 is again ready for use by employing the exposed ones of the tips 54 and 56.

As will be appreciated, the torque applied to the handle 12 is imparted to the exposed tip in the tube 26 through the collet 28 rather than through the pin 52. This is highly advantageous for applying greater torque without potential damage to the tool 10. As a result, the user can expect a much longer life than would be the case in the event the torque was carried by the pin 52.

When it is desired to use the tool 10 as a nut or bolt head driver, the appropriate one of the screwdriver tips is removed. The nut or bolt head can then be inserted into the corresponding one of the openings 20, 70 and 72. By reason of the magnetization of the components, the nut or bolt head be held in place as it is driven by the multi-function driving tool 10.

In the preferred embodiment, the multi-function driving tool 10 may by way of example be formed of aluminum or zinc die cast. It will be seen to comprise an 8-in-1 tool which includes six available tips of any size or kind, as well as three nut setters of at least two distinct sizes. Moreover, in its axially aligned position, the torque is transmitted entirely through components other than the pivoting pin assembly.

While in the foregoing, there has been set forth a preferred embodiment of the invention, it will be appreciated that the details herein given may be varied by those skilled in the art without departing from the true spirit and scope of the appended claims.

What is claimed is:

1. A multi-function tool, comprising:

an elongated handle having an axis with first and second ends disposed in axially spaced relation, said first end of said handle having an opening for axially receiving a screwdriver tip therein and said second end of said handle having an opening for receiving an elongated tube, said tube being releaseably retained in generally axially aligned relation to said handle by a collet disposed in said handle at a point intermediate said first and second ends thereof;

said handle having opposed side openings extending axially from said second end to a point near said collet in said handle;

means for pivoting said elongated tube relative to said elongated handle from a position in generally axially aligned relation to said handle to a position extending generally transversely thereof, said pivoting means accommodating limited axial sliding movement of said tube relative to said handle from a position where one of said ends of said tube is axially retained by said collet to a position where said one of said ends of said tube is no longer axially retained by said collet to position said tube so as to be generally in alignment with said side openings in said handle, said pivoting means then accommodating pivoting movement of said tube about an axis generally transverse to said axis of said handle through either of said side openings to said generally transversely extending position;

said elongated tube cooperating with said elongated handle in said generally transversely extending position to define a generally T-shaped handle for applying increased torque to said first handle end; and a screwdriver tip operatively associated with each of said ends of said elongated tube to project axially outwardly of said second end of said elongated handle when the other of said ends of said elongated tube is axially retained by said collet;

said elongated tube having an opening generally hexagonal in cross-section in each of said ends thereof, said screwdriver tips operatively associated with said tube each having an elongated shank also hexagonal in cross-section and further having a driving tip on each of opposite ends of said shank, said screwdriver tips being formed of a length sufficient for a portion to extend from each of said opening in said ends of said tube;

said collet being formed to have an opening to receive at least said portion of said screwdriver tip extending from said opening in either one of said ends of said elongated tube, and including means associated with said collet for cooperating with said portion of said screwdriver tip extending from said opening in either one of said ends for releaseably retaining said tube in generally axially aligned relation to said handle.

2. The multi-function tool of claim 1 wherein said opening in said first end of said elongated handle is generally hexagonal in cross-section, said screwdriver tip in said opening in said first end of said handle having an elongated shank also hexagonal in cross-section and further having a driving tip on each of opposite ends of said shank, and including means for releaseably retaining said screwdriver tip in said opening in said first end of said handle with one of said driving tips projecting therefrom.

3. The multi-function tool of claim 1 wherein said elongated tube has an opening generally hexagonal in cross-section in each of said ends thereof, said screwdriver tips operatively associated with said tube each having an elongated shank also hexagonal in cross-section and further having a driving tip on each of opposite ends of said shank, and including means for releaseably retaining said screwdriver tips in said openings in said ends of said tube with one of said driving tips projecting therefrom.

4. The multi-function tool of claim 1 wherein said pivoting means includes a pair of axially extending slots in said handle near said second end thereof, said axially extending slots being formed in said handle to lie in a plane extending generally transversely of a plane in which said tube undergoes pivoting movement relative to said handle, said pivoting means also including pin means associated with said tube and projecting into said slots to accommodate relative sliding and pivoting movement.

5. A multi-function tool, comprising:

an elongated handle having an axis with first and second ends disposed in axially spaced relation, said first end of said handle having an opening for axially receiving a screwdriver tip therein and said second end of said handle having an opening for receiving an elongated tube, said tube being releaseably retained in generally axially aligned relation to said handle by a collet disposed in said handle at a point intermediate said first and second ends thereof;

said screwdriver tip in said first end of said elongated handle having an elongated shank hexagonal in cross-section and a driving tip on each of opposite ends of said shank, said opening in said first end of said handle also being generally hexagonal in cross-section, and including means for releaseably retaining said screwdriver tip in said opening in said first end of said handle such that one of said driving tips is projecting therefrom;

said handle having opposed side openings extending axially from said second end to a point near said collet in said handle;

means for pivoting said elongated tube relative to said elongated handle from a position in generally axially aligned relation to said handle to a position extending generally transversely thereof, said pivoting means accommodating limited axial sliding movement of said tube relative to said handle from a position where one of said ends of said tube is axially retained by said collet to a position where said one of said ends of said tube is no longer axially retained by said collet to position said tube so as to be generally in alignment with said side openings in said handle, said pivoting means then accommodating pivoting movement of said tube about an axis generally transverse to said axis of said handle through either of said side openings to said generally transversely extending position;

said elongated tube cooperating with said elongated handle in said generally transversely extending position to define a generally T-shaped handle for applying increased torque to said first handle end; and a screwdriver tip operatively associated with each of said ends of said elongated tube to project axially outwardly of said second end of said elongated handle when the other of said ends of said elongated tube is axially retained by said collet;

said screwdriver tips associated with said tube each having an elongated shank hexagonal in cross-section and a driving tip on each of opposite ends of said shank, said elongated tube having an opening also generally hexagonal in cross-section in each of said ends thereof, and including means for releaseably retaining said screwdriver tips in said openings in said ends of said tube with one of said driving tips projecting therefrom;

said collet being formed to have an opening generally hexagonal in cross-section to receive at least a portion of said shank extending from said opening in either one of said ends of said elongated tube, and including means associated with said collet for cooperating with said portion of said shank extending from said opening in either one of said ends for releaseably retaining said tube in generally axially aligned relation to said handle.

6. The multi-function tool of claim 5 wherein said pivoting means includes a pair of axially extending slots in said handle near said second end thereof, said axially extending slots being formed in said handle to lie in a plane extending generally transversely of a plane in which said tube undergoes pivoting movement relative to said handle, said pivoting means also including pin means associated with said tube and projecting into said slots to accommodate relative sliding and pivoting movement.

7. The multi-function tool of claim 5 wherein said handle is defined by four sides so as to be generally square in cross-section, said elongated tube being generally circular in cross-section and of a diameter less than the spacing between inner surfaces of opposing sides of said handle to accommodate pivoting movement of said tube relative to said handle, said opposed side openings in said handle also being of a width sufficient to accommodate pivoting movement of said tube relative to said handle.

8. The multi-function tool of claim 5 wherein said elongated tube is of a length greater than the distance between said collet and said second end of said elongated handle, said pivoting means including a pin extending transversely of said axis of said tube and disposed in a pair of axially extending slots in said handle, said slots being positioned and of a length to permit either end of said tube including said screwdriver tip to be pivoted freely through either of said side openings in said handle.

9. A multi-function tool, comprising:

an elongated handle having an axis with first and second ends disposed in axially spaced relation, said first end of said handle having an opening for axially receiving a screwdriver tip therein and said second end of said handle having an opening for receiving an elongated tube, said tube being releaseably retained in generally axially aligned relation to said handle by a collet disposed in said handle at a point intermediate said first and second ends thereof;

said screwdriver tip in said first end of said elongated handle having an elongated shank hexagonal in cross-section and a driving tip on each of opposite ends of said shank, said opening in said first end of said handle also being generally hexagonal in cross-section, and including means for releaseably retaining said screwdriver tip in said opening in said first end of said handle such that one of said driving tips is projecting therefrom;

said handle having opposed side openings extending axially from said second end to a point near said collet in said handle;

means for pivoting said elongated tube relative to said elongated handle from a position in generally axially aligned relation to said handle to a position extending generally transversely thereof, said pivoting means accommodating limited axial sliding movement of said tube relative to said handle from a position where one of said ends of said tube is axially retained by said collet to a position where said one of said ends of said tube is no longer axially retained by said collet to position said tube so as to be generally in alignment with said side openings in said handle, said pivoting means then accommodating pivoting movement of said tube about an axis generally transverse to said axis of said handle through either of said side openings to said generally transversely extending position;

said pivoting means including a pair of axially extending slots formed in said handle near said second end to lie in a plane extending generally transversely of a plane in which said tube undergoes pivoting movement, said pivoting means also including a pin integral with and extending transversely of said axis of said tube to project into said slots to accommodate relative sliding and pivoting movement of said tube relative to said handle;

said elongated tube cooperating with said elongated handle in said generally transversely extending position to define a generally T-shaped handle for applying increased torque to said first handle end; and a screwdriver tip operatively associated with each of said ends of said elongated tube to project axially outwardly of said second end of said elongated handle when the other of said ends of said elongated tube is axially retained by said collet;

said screwdriver tips associated with said tube each having an elongated shank hexagonal in cross-section and a driving tip on each of opposite ends of said shank, said elongated tube having an opening also generally hexagonal in cross-section in each of said ends thereof, and including means for releaseably retaining said screwdriver tips in said openings in said ends of said tube with one of said driving tips projecting therefrom;

said collet being formed to have an opening generally hexagonal in cross-section to receive at least a portion of said shank extending from said opening in either one of said ends of said elongated tube when said tube is in generally axially aligned relation to said handle, and including means associated with said collet for cooperating with said portion of said shank extending from said opening in either one of said ends for releaseably retaining said tube in generally axially aligned relation to said handle.

10. The multi-function tool of claim 9 wherein said handle is defined by four sides so as to be generally square in cross-section, said elongated tube being generally circular in cross-section and of a diameter less than the spacing between inner surfaces of opposing sides of said handle to accommodate pivoting movement of said tube relative to said handle, said opposed side openings in said handle also being of a width sufficient to accommodate pivoting movement of said tube relative to said handle.

11. The multi-function tool of claim 9 wherein said tube is of a length sufficient to always project outwardly of said handle when said tube is generally in axially aligned relation to said handle, said slots being axially positioned and of a length to permit either end of said tube including said screwdriver tip therein to be pivoted freely through either of said side openings when said pin is nearest said second end of said handle.

12. The multi-function tool of claim 9 wherein said tube is of a length sufficient to always project outwardly of said handle when said tube is generally in axially aligned relation to said handle, said slots being axially positioned and of a length to permit neither end of said tube nor said screwdriver tip therein to be pivoted freely through either of said side openings when said pin is furthest from said second end of said handle.

13. The multi-function tool of claim 9 wherein said hexagonal opening in said first end of said handle is of a size to receive a standard hexagonal nut or bolt head therein and wherein said hexagonal openings in each of said ends of said tube are of a size to receive a standard hexagonal nut or bolt head therein.

14. The multi-function tool of claim 9 wherein said handle, tube and screwdriver tips are all formed of metal which has been magnetized, said magnetized metal comprising said means for releaseably retaining said screwdriver tips in said openings in said first end of said handle and said ends of said tube.

15. The multi-function tool of claim 10 wherein said handle has a pocket clip on one of said sides of said handle adjacent said first end thereof.

* * * * *

UNITED STATES PATENT AND TRADEMARK OFFICE

CERTIFICATE OF CORRECTION

PATENT NO. : 5,450,775

DATED : September 19, 1995

INVENTOR(S) : KOZAK, Burton

It is certified that error appears in the above-identified patent and that said Letters Patent is hereby corrected as shown below:

Column 4, line 67, replace "on" with --one--;

Column 6, line 17, replace "fist" with --first--; and

In the Abstract, line 17, replace "handled" with --handle--.

Signed and Sealed this

Second Day of January, 1996

*Attest:*

Bruce Lehman

BRUCE LEHMAN

*Attesting Officer*

*Commissioner of Patents and Trademarks*